United States Patent [19]

Jullien

[11] Patent Number: 4,515,109

[45] Date of Patent: May 7, 1985

[54] APPARATUS FOR THE PRODUCTION OF STEAM BY HEAT EXCHANGE BETWEEN A HEAT-TRANSFER LIQUID METAL AND FEED WATER, COMPRISING SEVERAL LIQUID METAL/INERT GAS INTERFACES

[75] Inventor: Georges Jullien, Saint Michel sur Orge, France

[73] Assignee: Novatome, Le Plessls-Robinson, France

[21] Appl. No.: 470,807

[22] Filed: Feb. 28, 1983

[30] Foreign Application Priority Data

Mar. 11, 1982 [FR] France ..... 82 04076

[51] Int. Cl.[3] ..... F22B 1/02

[52] U.S. Cl. ..... 122/32; 122/504; 165/104.32; 165/134 R; 376/370

[58] Field of Search ..... 122/32, 33, 34, 35, 122/37, 504, 508; 165/134 R, 104.32, DIG. 24; 376/370

[56] References Cited

U.S. PATENT DOCUMENTS

| | | | |
|---|---|---|---|
| 3,498,880 | 3/1970 | Gollion | 165/104.32 |
| 3,924,675 | 12/1975 | Essebaggers | 122/32 |
| 3,930,537 | 1/1976 | Wolowodiuk | 122/32 |
| 4,083,707 | 4/1978 | Bivins, Jr. | 122/32 |
| 4,296,713 | 10/1981 | Taylor et al. | 122/32 |
| 4,307,685 | 12/1981 | Robin et al. | 165/134 R |

*Primary Examiner*—Edward G. Favors
*Assistant Examiner*—Steven E. Warner
*Attorney, Agent, or Firm*—Pollock, Vande Sande & Priddy

[57] ABSTRACT

Apparatus for the production of steam by heat-exchange between a heat-transfer liquid metal and feed-water, comprising an envelope (1) containing a tube bundle (8) which occupies only part of the internal volume of the envelope with the bundle (8) in which the feed water is passed in. At least two superposed compartments (18, 28), in communication with the internal volume of the envelope (1) by their lower part, are located inside the envelope (1). Each of the compartments (18, 28) communicates with the compartment located thereabove by means of a first tube (23), and with the compartment located therebelow by means of a second tube (21). The compartment (**28*a*) located at the lowest level is fed with inert gas through the establishment of liquid/inert gas interfaces in each of the compartments (18, 28**). The invention applies particularly to the steam generators of fast neutron nuclear reactors, in which it is desired to avoid the harmful effects of pressure waves in case of a sodium/water reaction.

4 Claims, 2 Drawing Figures

APPARATUS FOR THE PRODUCTION OF STEAM BY HEAT EXCHANGE BETWEEN A HEAT-TRANSFER LIQUID METAL AND FEED WATER, COMPRISING SEVERAL LIQUID METAL/INERT GAS INTERFACES

FIELD OF THE INVENTION

The invention relates to an apparatus for the production of steam by heat exchange between a heat-transfer liquid metal and feed water, comprising several liquid metal/inert gas interfaces.

BACKGROUND OF THE INVENTION

Most frequently, fast neutron nuclear reactors cooled by a liquid metal, which represents the primary fluid of the reactor, comprise intermediate heat exchangers, in which the heating of a liquid metal is brought about, this liquid metal representing the intermediate fluid, which is used, in turn, for the vaporization of the feed water in the steam generators.

These steam generators possess a cylindrical envelope, having a vertical shaft and being closed by convex ends, inside which the tube bundle is located. This bundle, generally consisting of spirally wound tubes, occupies only part of the cross-section of the internal volume of the envelope and extends over only part of the height of the envelope.

Above the bundle there is a zone into which issues at least one inlet pipe for secondary liquid sodium heated by the primary sodium in an intermediate exchanger, while the lower part of the steam generator is provided with an outlet pipe for the cooled secondary liquid sodium.

Between its entry and its exit from the envelope of the steam generator, the secondary liquid sodium circulates in contact with the external surface of the tubes of the tube bundle, inside which feed water circulates, and is vaporized by heat exchange with the secondary liquid sodium.

One end of the tubes of the bundle is connected to a water-feed device, while the other end of the tubes of the bundle is connected to a steam-collector device.

During its downward passage in contact with the tube bundle, the secondary liquid sodium is cooled. This cooled sodium is returned to the intermediate exchangers to be heated and to cool the primary sodium.

In the steam generators of the fast neutron nuclear reactors currently built, the central part of the internal volume of the envelope is taken up by a cylindrical central body, co-axial with the envelope of the steam generator, from the lower part of the steam generator to the upper zone where the secondary liquid sodium enters. The tube bundle takes up the peripheral part of the internal volume of the envelope, around the central body and over the entire height of the latter, with the exception of its lower part, in which apertures enable secondary liquid sodium to be recovered after passing through the bundle.

The feed of secondary sodium and the circulation of the latter in the steam generator are regulated so that the top level of this secondary sodium in the envelope of the generator is located slightly above the sodium inlet, in the upper part of the envelope.

The space between the top level of the sodium and the top end of the steam generator is filled by an inert gas, such as argon.

In the case of water leaking onto one of the tubes of the tube bundle, a violent reaction takes place between the liquid sodium and the water and a pressure wave passes through the steam generator from the place where the leak appeared to the liquid sodium/inert gas interface where this pressure wave is reflected and its pressure is gradually released.

These pressure waves can damage not only the heat exchanger, but also the various components of the secondary sodium circuit.

It is therefore necessary to promote the propagation of the pressure waves towards the free level of the liquid sodium where these waves are absorbed.

Moreover, the passage of the pressure wave through the steam generator to the free level of the liquid sodium is generally very long, whereas it would be desirable for these pressure waves to reach a free surface as quickly as possible.

To date, simple apparatus, was known which, though occupying little space, enabled the pressure waves which can arise in a steam generator containing liquid metal to be absorbed very rapidly.

The object of the invention, therefore, is to propose an apparatus for the production of steam by heat exchange between a heat-transfer liquid metal and feed water, this apparatus possessing a cylindrical envelope, having a vertical shaft and being closed by solid ends, inside which a tube bundle is located which occupies only part of the cross-section of the internal volume of the envelope, over only part of the height of this envelope, at least one pipe for introducing heat-transfer liquid metal into the envelope, passing through the latter into a zone located above the tube bundle, at least one outlet pipe for the liquid metal, passing through the envelope in its lower part, means for feeding the tubes of the bundle with feed water, and means for the recovery of the steam produced in the tube bundle by heat exchange between the liquid metal, circulating in contact with the surface of the tubes of the bundle, and the feed water, the top level of the liquid metal having above it an inert gas which fills the top part of the envelope and this apparatus, enabling rapid absorption of the pressure waves which can arise in the case of water leakage in the tube bundle, wherever the leak may be.

To this end, at least two compartments are constructed inside the envelope in a zone that is not taken up by the tube bundle, located above one another and delimited by walls creating a passage for the liquid metal between the compartment and the internal volume of the envelope, in the lower part of each compartment, each of the compartments being placed in communication with the compartment located directly above by means of an approximately vertical first tube, and with the compartment located directly below by means of an approximately vertical second tube, both tubes issuing at a certain height into the compartment under consideration, so that the end of the second tube is above the end of the first tube, the compartment, located at the highest level in the envelope communicating with the upper part of the envelope filled with inert gas, while the compartment located at the lowest level is in communication with a reserve of inert gas for establishing liquid metal/inert gas interfaces in each of the successive compartments, through the introduction of inert gas from the compartment located at the lowest level.

For a complete understanding of the invention, an embodiment of a steam generator of a fast neutron nuclear reactor cooled by means of liquid sodium and comprising several liquid sodium/inert gas interfaces will now be described, with reference to the attached drawings.

DETAILED DESCRIPTION

Figure 1:
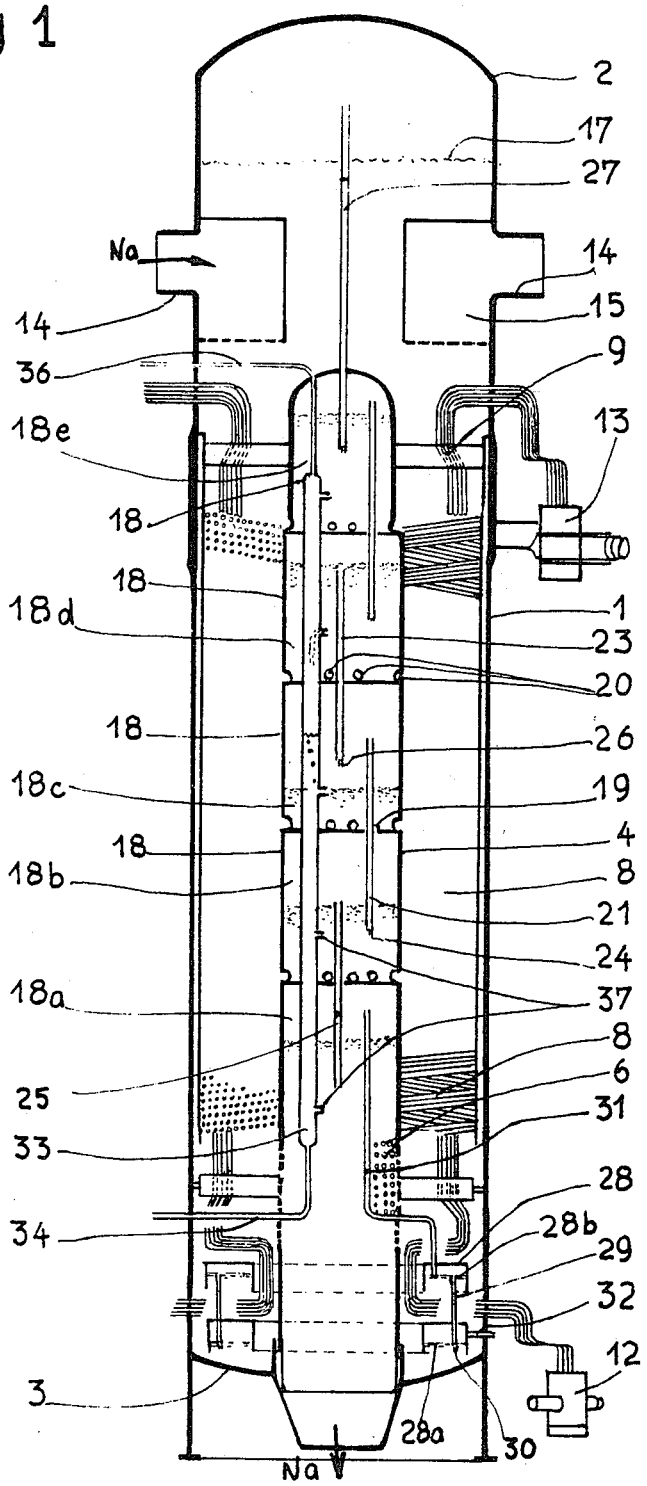
FIG. 1 represents a view in section through a vertical plane of symmetry of the steam generator.

The steam generator possesses a cylindrical envelope 1, which is very long relative to its diameter, located with its shaft in the vertical position. This envelope is closed by two convex ends 2 and 3 at its top and bottom respectively.

A hollow cylindrical central body 4 is fixed inside the envelope, co-axially with the envelope 1. This central body 4 is open at its lower part and passes through the lower convex base 3 of the steam generator. Apertures 6 are placed in the lower part of the central body, so as to allow the internal part of the latter to communicate with the peripheral part of the steam generator, located around the central body 4.

This peripheral part contains the tube bundle 8, spirally wound in the annular space between the central body 4 and the envelope 1 of the steam generator.

At one of their ends, the tubes are connected to a valve 12, enabling the feed water to be sent into each of the tubes of the bundle, and, at their other end, these tubes are connected to a steam collector 13, enabling the steam to be recovered that is produced in the tubes brought into contact by their exterior surface with hot liquid sodium.

The liquid sodium is introduced through pipes 14 into the envelope 1 at the level of a distributor 15, which enables the hot sodium, introduced through the pipes 14, to be uniformly distributed across the whole cross-section of the bundle 8.

The sodium introduced into the pipes 14 comes from intermediate exchangers of a fast neutron nuclear reactor, cooled by primary liquid sodium which, in turn, serves for heating the secondary liquid sodium in the intermediate exchangers, this heated secondary sodium being sent to the steam generator. The hot secondary sodium passes down along the bundle 8 inside the steam generator, brings about the evaporation of the feed water inside the tubes of the bundle, is then evacuated into the central body 4 through the apertures 6 at the base of the bundle and leaves the apparatus through the lower end.

The space between the level 17 and the upper end 2 is filled with inert gas, for example argon.

The central body 4 is divided, over part of its height, at the level of the bundle 8, into a certain number of superposed compartments 18 by means of horizontal partitions 19.

In the lower part of each of the compartments 18, the side wall of the cylindrical central body 4 is pierced by apertures 20, which place the interior space of the central body 4 in communication with the peripheral zone of the envelope containing the bundle 8.

Each of the compartments 18, such as the compartment 18*c*, communicates with the compartment 18*b*, located directly below, by means of a vertical tube 21, and with the upper compartment 18*d* by means of a vertical tube 23.

Each of the vertical tubes, such as 21 and 23, possesses at its lower part a closure element having a calibrated orifice, such as 24 or 26, for increasing and regulating the pressure drop in the vertical tube.

The compartment 18*e* located in the upper part of the central body 4, is placed in communication with the compartment 18*d* located directly below, and with the space between the level 17 and the upper base 2, filled with argon, by means of a very long vertical tube 27.

The lower part of the envelope of the steam generator, below the bundle, contains two annular compartments 28, which are open at their lower part and communicate with each other with the aid of a vertical tube 29 equipped with a pressure drop device 30.

The upper annular compartment 28*b* is connected by a very long tube 31 to the space of the central body 4 located directly below the compartment 18*b* and forming the compartment 18*a* located at the lowest level inside the central body 4.

The lower annular compartment 28*a* is connected to a reserve of low-pressure argon by means of a pipe system 32.

At the level of the compartments 18, the interior of the central body contains a tube 33 for the evacuation of argon and sodium, connected, at its lower part, to a low-pressure sodium reservoir by means of a very long pipe 34 and, at its upper part, to the argon atmosphere blanketing the low-pressure sodium reservoir by means of a very long pipe 36.

The tube 33 possesses, in its wall, calibrated orifices 37 at a level below the bottom level of the tubes 21.

The tube 33 enables argon or sodium to be evacuated during the operation of the steam generator.

Before the steam generator is brought into operation, the envelope 1 of the latter is filled with liquid sodium up to the level 17.

Argon is then passed into the interior of the lower annular compartment 28*a* through the pipe system 32.

The sodium level in the annular compartment is established at the level of the lower part of the tube 29 having the calibrated orifice 30. The supplementary argon sent into the compartment 28*a* then passes into the upper compartment 28*b* where the sodium level goes down and establishes itself at the level of the lower part of the tube 31.

The argon then passes into the compartment 18*a* where the sodium level goes down to the bottom level of the tube 25.

Thus the argon sent into the steam generator through the pipe 32 enables liquid sodium/argon interfaces to be gradually established in each of the compartments 18 up to the compartment 18*e* located at the top part of the central body 4.

If excess argon is supplied, this is passed into the upper argon reservoir above the level 17.

The steam generator can then be put into operation, the secondary sodium circuit pumps bring about circulation of sodium inside the steam generator and the top level of the sodium 17 remains above the inlet pipes 14 through regulation of the blanketing argon.

During its passage into the bundle 8, the sodium undergoes a pressure drop which is translated into a difference in pressure between the lower parts of each of the compartments located above one another.

During the operation of the steam generator, the variations in the flow rate of sodium in the steam generator and the variations in the temperature of this sodium are translated into variations in pressure difference between the lower parts of the various compartments, since the apertures 20 place these lower parts of the compartments in communication with the peripheral zone of the steam generator where the secondary sodium circulates in contact with the bundle.

These sodium pressure differences are translated into circulations of sodium or argon between the various compartments through these compartments being placed into communication with the aid of the vertical tubes.

These tubes are arranged so that the top end of the tube which places any compartment in communication with the lower compartment is at a level above the bottom end of the tube which places this compartment in communication with the compartment located above.

It can thus be seen that, in the compartment 18*c*, the top end of the tube 21 is at a level above the bottom end of the tube 23 which has the calibrated orifice 26.

During the operation of the steam generator, the sodium/argon interface in each of the compartments located along the height of the steam generator is capable, in this way, of varying between two limits.

There are hence always free levels in each of the compartments located in succession along the height of the steam generator.

In case of a leak in the tube bundle conveying the feed water, the pressure wave resulting from the sodium/-water reaction meets a free sodium/argon level very quickly, since this wave begins to propagate in radial directions of the steam generator towards the central body which possesses a plurality of superimposed levels.

Similarly, the waves propagating in the axial direction of the steam generator and downwards very quickly meet the free levels inside the annular compartments 28.

The pressure waves are thus absorbed very quickly after their appearance, which avoids the possibility of the steam generator being destroyed.

In order to limit the circulation flow rate in the tubes 21, it is advantageous to create a pressure drop at the level of the lower part of each tube in communication with the upper compartment.

Circulation of argon from one compartment to the other by means of the tubes enables layers of argon to be formed in the upper part of the compartments which is completely fluid-tight.

In the case where the sodium/argon interface in a compartment tends to go below the level of the corresponding aperture 37 of the argon recovery tube 33, the argon is evacuated towards the reservoir formed by the low-pressure argon blanket of a sodium reservoir, for example, a low-pressure reservoir of the main circuit of the nuclear reactor.

The sodium level in the evacuation device 33 is maintained by placing the lower part of the tube 33 in communication, by means of pipe 34, with a low-pressure sodium reservoir, for example the pump of the secondary circuit or the storage reservoir of this secondary sodium.

In practice, if the length of the connecting tubes between the compartments is greater than the pressure drop between the orifices located at the base of two successive compartments, the argon evacuation tube is not indispensable for ensuring adequate circulation of argon between the compartments in all cases. The argon evacuation tube 33 can be omitted if throwing back a small amount of gas towards the bundle 8 is an acceptable possibility.

Figure 2:
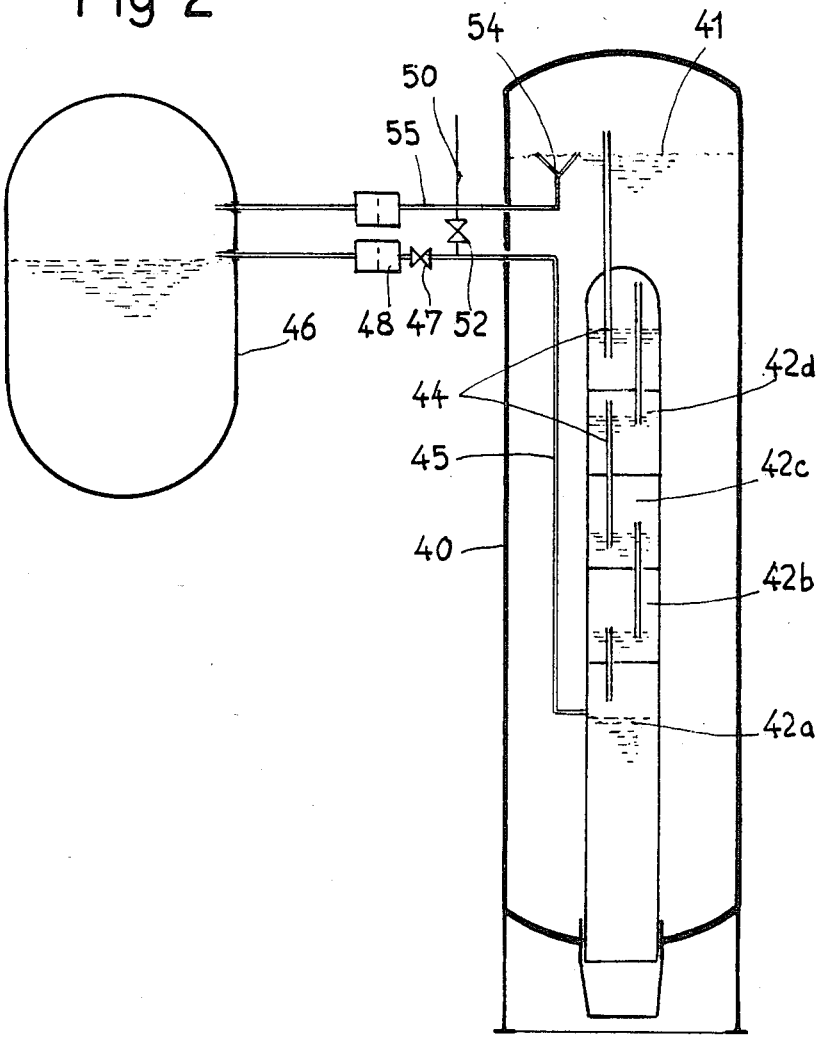
FIG. 2 represents an alternative form of the steam generator with a simplified device for the evacuation of argon.

FIG. 2 shows an alternative embodiment of a steam generator according to the invention in simplified illustration.

Compartments 42*a*, 42*b* 42*c* and 42*d* are arranged above one another inside the envelope 40 of the steam generator containing liquid sodium up to the level 41 and enclosing the bundle. Each of the compartments 42 has apertures in its side wall, in the lower part of the latter, placed the interior of the compartment in communication with the internal volume of the envelope 40, surrounding the bundle which is immersed in the circulating liquid sodium.

The compartments 42 are placed in communication with one another by means of vertical tubes 44 as described above.

The lower compartment 42*a* is connected by a pipe 45 to the upper part of the liquid sodium reserve 46, inserted in the secondary circuit (or at the upper part of a secondary pump). In its upper part, the reservoir 46 contains low-pressure argon above the liquid sodium. A valve 47 and a flow governor 48 are located on the pipe 45. The pipe 45 enables argon to be evacuated towards the reservoir 46. A branch pipe 50 on the pipe 45, between the compartment 42*a* and the valve 47, is connected to a source of pressurized argon by means of a valve 52.

An overflow pipe 54, discharging into a pipe 55, enables the sodium or argon from the upper reservoir of the steam generator to be collected in the reservoir 46, (level regulation).

In the apparatus shown in FIG. 2, evacuation of argon is brought about solely through the pipe 45 connected to the lower compartment 42*a*.

Supply of pressurized argon to the compartments is similarly effected through the pipe 45.

This apparatus is therefore much simpler than that shown in FIG. 1. However, if the pressure drop in the steam generator is large, sodium may flow into the tubes 44. For this reason, the tubes are designed so that:

1. the differences in the levels between the bottom ends of two successive tubes 44 increases from the bottom to the top of the steam generator, in the case where the compartments have equal height;

2. the length of the tubes 44 also increases from the bottom to the top of the steam generator.

It can be seen that the main advantages of the apparatus according to the invention are to enable the pressure waves to be absorbed rapidly, after their appearance, at any point of the zone of the steam generator where the bundle is placed, to absorb these waves regardless of their direction of propagation in the radial or axial directions of the steam generator and to avoid any entrainment of argon by the sodium circulating in the tube bundle.

These results are obtained despite a simple and compact design of the devices for creating free levels inside the steam generators.

In particular, if the compartments in which the sodium/argon interfaces are created are arranged inside the central body and below the upper part of the bundle, best use can be made of the dead spaces in the internal volume of the steam generator.

The superimposed compartments may be located in other parts of the internal volume of the steam generator, and these compartments can have a shape other than a cylindrical or annular shape.

The partitions of these compartments can be planar or, on the contrary, can have the stage of surfaces of revolution, the median line of which is, for example, a basket-handle type of curve.

The annular compartments, located in the base of the steam generator, can be connected by means of welded radial ribs, either on the outer surface of the central body or on the internal surface of the envelope of the steam generator.

The flow-restriction devices, which increase the pressure drop at the bottom of the communication tubes between the compartments, can be made in the form of simple calibrated orifices or of more complex devices, the pressure drop of which varies with the direction of circulation of the fluid inside the tube.

The invention applies to the case of a steam generator effecting vaporization by heat exchange with any liquid metal, and the inert gas introduced into the superimposed compartments can be a rare gas, such as argon, or a simple inert gas, such as nitrogen.

Finally, the apparatus according to the invention applies not only to steam generators of fast neutron nuclear reactors, but also to any steam generator using a liquid metal capable of violent reaction with the feed water.

I claim:

1. Apparatus for the production of steam by heat exchange between a heat-transfer liquid metal and feed water, comprising (a) a cylindrical envelope (1), having a vertical axis closed by solid ends (2, 3);

(b) a hollow cylindrical central body (4) and a peripheral tube bundle (8) coaxially disposed within said envelope over only a portion of its height;

(c) at least one pipe (14) for introducing heat-transfer liquid metal into said envelope (1), said at least one pipe passing through the latter into a zone located above said tube bundle (8);

(d) at least one outlet pipe for the liquid metal, passing through the lower part of said envelope (1);

(e) means (12) for feeding the tubes of said bundle with feed water;

(f) means (13) for the recovery of steam produced in said tube bundle (8) by heat exchange between the liquid metal, circulating in contact with the surface of said tubes of said bundle, and said feed water, the top level (17) of the liquid metal having above it inert gas which fills the top part of said envelope; and (g) a plurality of superposed compartments within said central body and separated from one another by transverse partitions (19) located at different heights inside said central body, apertures (20) being provided in a side wall of said central body in the lower part of each said compartment (18, 28) and each of said compartments (**18*c*) being placed in communication with the compartment located directly thereabove (18*d*) by means of a substantially vertical first tube (23), and with the compartment (18*b*) located directly therebelow by means of a substantially vertical second tube (21), both tubes issuing into the compartment (18*c*) under consideration at a height such that the end of said second tube (21) is above the end of said first tube (23), the compartment located at the highest level (18*e*) communicating with the upper part of said envelope (1) filled with inert gas, while the compartment (28*a*) located at the lowest level is in communication with a reserve of neutral gas for establishing liquid metal inert gas interfaces in each of the successive compartments (18), through the introduction of inert gas from the compartment (28*a***) located at the lowest level.

2. Apparatus as claimed in claim 1, comprising at least one compartment having an annular shape inside said envelope and outside said central body around its lower part, below said tube bundle and in communication with the lower compartment in said central body and with a reserve of neutral gas in the place of the lowest compartment in said central body.

3. Apparatus as claimed in claim 1 or 2, wherein said vertical tubes placing successive compartments in communication comprise at their lower ends closure elements having a calibrated orifice of limited section compared to the section of the tube, for restricting the flow and pressure of fluids passing in the tubes from one compartment to another.

4. Apparatus as claimed in claim 2, comprising a tube (33) located vertically inside said central body (4) throughout the zone in which said compartments (18) are located, the upper part of said tube being connected to a reservoir of low-pressure inert gas, the lower part of said tube being connected to a reservoir of low-pressure liquid metal, a lateral surface of said tube having, at the level of each of said compartments (18), a calibrated orifice (37) for evacuation of neutral gas present in a said compartment (18) under consideration.

* * * * *